US009901508B2

(12) United States Patent
Fitzmaurice

(10) Patent No.: US 9,901,508 B2
(45) Date of Patent: Feb. 27, 2018

(54) THERAPY TOOL

(71) Applicant: David Fitzmaurice, Tucson, AZ (US)

(72) Inventor: David Fitzmaurice, Tucson, AZ (US)

(73) Assignee: David Fitzmaurice, O'Fallon, MO (US)

( * ) Notice: Subject to any disclaimer, the term of this patent is extended or adjusted under 35 U.S.C. 154(b) by 0 days.

(21) Appl. No.: 14/592,049

(22) Filed: Jan. 8, 2015

(65) Prior Publication Data

US 2015/0150751 A1 Jun. 4, 2015

Related U.S. Application Data

(63) Continuation of application No. 11/279,847, filed on Apr. 14, 2006, now abandoned.

(60) Provisional application No. 60/673,891, filed on Apr. 18, 2005.

(51) Int. Cl.
*A61H 15/00* (2006.01)

(52) U.S. Cl.
CPC . *A61H 15/0092* (2013.01); *A61H 2015/0014* (2013.01); *A61H 2015/0021* (2013.01); *A61H 2201/169* (2013.01)

(58) Field of Classification Search
CPC ..... A61H 15/00; A61H 15/0085; A61H 15/0092; A61H 39/00; A61H 39/04; A61H 2015/00; A61H 2015/0007; A61H 2015/0014; A61H 2015/0021; A61H 2015/0028; A61H 2015/0035; A61H 2015/0042; A61H 2015/005; A61H 2015/0064; A61H 2201/169; A61H 2201/1695
See application file for complete search history.

(56) References Cited

U.S. PATENT DOCUMENTS

| | | | |
|---|---|---|---|
| 1,071,998 | A | 9/1913 | Gibbs |
| 1,663,775 | A | 4/1927 | Rollason |
| 1,663,975 | A | 3/1928 | David |
| 1,958,936 | A | 5/1934 | Bajette et al. |
| 2,221,785 | A | 8/1936 | Douglas |
| 2,572,627 | A | 2/1950 | Kelly |
| 3,060,928 | A | 7/1961 | Lowe |
| 3,067,738 | A | 12/1962 | Karlik |
| 3,548,814 | A | 12/1970 | Montgomery et al. |
| 3,756,224 | A | 9/1973 | Laymon |
| 3,970,078 | A | 7/1976 | Rogers, Jr. |

(Continued)

OTHER PUBLICATIONS

U.S. Appl. No. 11/279,847, Non-Final Office Action, dated Sep. 16, 2009, 5 pages.

(Continued)

*Primary Examiner* — Quang D Thanh
(74) *Attorney, Agent, or Firm* — Dennis A. Bennett; Clifford A. Schlecht

(57) ABSTRACT

A therapy tool for treating muscular and/or myofascial pain comprises a shaft having rotatedly mounted thereon at least two roller wheels. At least one of the roller wheels has a polarity of projections evenly spaced around the wheels' periphery by in which the projections are generally flat at their outer surface and have a round edge. In one embodiment at least one of the roller wheels has a smooth peripheral edge which may be used to identify the presence of trigger points and adhesions.

20 Claims, 2 Drawing Sheets

(56) References Cited

U.S. PATENT DOCUMENTS

| | | | | | |
|---|---|---|---|---|---|
| 4,345,757 | A | * | 8/1982 | Lo Voi | A61H 15/0092 482/132 |
| 4,648,387 | A | | 5/1987 | Simmons | |
| D352,786 | S | | 11/1994 | Hwang | |
| 5,364,338 | A | | 11/1994 | Terashima | |
| 5,709,705 | A | | 1/1998 | Belcher | |
| 5,755,677 | A | | 5/1998 | Masuda et al. | |
| 6,135,972 | A | * | 10/2000 | Kuo | A61H 15/0092 601/119 |
| 6,267,738 | B1 | | 7/2001 | Louis | |
| 6,315,742 | B1 | | 11/2001 | Howard | |
| 6,419,650 | B1 | | 7/2002 | Ryan et al. | |
| 6,878,124 | B1 | | 4/2005 | Crowe | |
| 7,223,251 | B1 | | 5/2007 | Phillips | |
| 2003/0088198 | A1 | | 5/2003 | Carpenter | |
| 2004/0106883 | A1 | | 6/2004 | Pidcock | |

OTHER PUBLICATIONS

U.S. Appl. No. 11/279,847, Final Office Action, dated Feb. 24, 2010, 8 pages.
U.S. Appl. No. 11/279,847, Non-Final Office Action, dated Oct. 7, 2010, 8 pages.
U.S. Appl. No. 11/279,847, Final Office Action, dated Jun. 8, 2011, 9 pages.
U.S. Appl. No. 11/279,847, Non-Final Office Action, dated Apr. 4, 2014, 18 pages.
U.S. Appl. No. 11/279,847, Applicant-Initiated Interview Summary, dated May 9, 2014, 3 pages.
U.S. Appl. No. 11/279,847, Final Office Action, dated Jul. 9, 2014, 13 pages.

* cited by examiner

THERAPY TOOL

CROSS REFERENCE TO RELATED APPLICATION

This application is a continuation of U.S. patent application Ser. No. 11/279,847, filed Apr. 14, 2006, now abandoned, and claims priority from U.S. Provisional Application Ser. No. 60/673,891 filed Apr. 18, 2005. Each of the above-referenced applications is expressly incorporated by reference herein its entirety.

FIELD OF THE INVENTION

The present invention relates generally to therapy tool and more particularly to a rolling tool for treating muscular, myofascial pain, and adhesions. The device of the present invention advantageously may be used for identifying trigger points and for providing trigger point therapy and myofascial release, although other uses are contemplated including treating general muscle soreness relief and treating adhesions and scar tissues to increase their elasticity and plasticity, as will be discussed below.

BACKGROUND OF THE INVENTION

Musculoskeletal evaluation and treatment applications have been used extensively in pain relief, massage therapy and chiropractic clinics. Different methods of application and different therapy tools have been experimented with and tried in an effort to find the most effective tool with which both the clinician and the patient could find and treat some of the most common and widespread causes of muscular and myofascial pain and dysfunction.

It is well documented in the literature that one of the primary and oftentimes overlooked causes of musculoskeletal pain syndromes are trigger points. A trigger point is a focal area of contracted muscle tissue which dramatically effects normal muscle function and physiology. In their book *Myofascial Pain and Dysfunction: The Trigger Point Manual* (1999) Drs. Travell and Simons present a very detailed description of the science and impact of trigger points and their effect on musculoskeletal pain and dysfunction. A trigger point is described as "a highly irritable localized spot of exquisite tenderness in a nodule in a palpable taut band of muscle tissue."

Trigger points can develop and create dysfunction in any of the over two hundred pairs of muscles in the body. Travell and Simons have stated that trigger points are a component of up to 93 percent of the pain seen in pain clinics.

Trigger points can decrease the oxygenation to the involved muscle which will result not only in pain but also a lack of nutrients to the involved site. The restricted blood flow is believed due to abnormally high internal muscle pressure resulting from muscle bundle tightness and shortness. They can also cause peripheral nerve compression as they pass through the involved muscle resulting in tingling, burning, numbness and hyperesthesia. Taut muscle fibers will also decrease lymphatic drainage and may result in a pooling of the byproducts of normal muscle metabolism primarily lactic acid which will result in muscle soreness. Trigger points also can effect movement by keeping the effected muscle short and tight which will reduce range of motion and impose a functional ceiling on muscle performance. And, trigger points can maintain muscle spasms, they can prevent the muscles from relaxing causing them to fatigue quickly, recover slowly from exertion and performance, and contract abnormally when they are performing. It must always be remembered that there are no trigger points in healthy muscles.

Different treatment methods have been used for years in trigger point therapy and myofascial release. They range from different forms of manipulation and manual therapy as well as the use of various electro-stimulation devices and mechanical devices including probes and rollers. However, prior to the present invention, none of the currently available mechanical probes and rollers have been found to be particularly effective for detection and elimination of trigger points and therefore the relief from many myofascial pain syndromes. Currently available roller type instruments only roll the muscle and do not effectively penetrate or stretch the muscle or overlying fascia. And, while more probing instruments would get deep in the tissue, they rely on the skill of the clinician or individual to try to find the appropriate trigger point and accurately treat same. Another disadvantage is that probes do not affect the entire muscle.

Thus exists a need for a mechanical, easy to use instrument that will provide both superficial and deep pressure relief for effective myofascial release and also permit the user to identify the location of trigger points.

SUMMARY OF THE INVENTION

The foregoing and other disadvantages of the prior art are provided by a hand roller therapy device made in accordance with the present invention. The key to the present invention is in the wheel design itself. More particularly, I have found that the wheels must include spaced projections and that the size and shape of the spaced projections must be within a carefully controlled range. More particularly, I have found through empirical testing that size, shape and spacing of projections, and wheel dimension are important based on the specific myofascial muscular tissue or adhesion being treated. Thus, it is important to keep the roller wheels within a diameter of ¾-6 inches depending on the tissues to be addressed (preferably about 2.0 inches). The wheels should include 8 to 12 projections, preferably 8, evenly spaced around the wheel's periphery. The projections should have a height of approximately 0.250 to 0.400 inches, preferably about 0.3125 inches, and a width, at their widest point of about 0.200 to 0.283 inches, preferably about 0.280 inches. The projections should be generally flat at their outer surface, but have a rounded edge. In a preferred embodiment of the invention, several roller devices having varying wheel sizes and shapes may be provided as a kit.

Forming the massage roller wheel in accordance with the above unexpectedly provides the ability to both penetrate or stretch muscle and overlying fascia.

BRIEF DESCRIPTION OF THE DRAWINGS

Further features and advantages of the present invention will be seen from the following detailed description, taken in conjunction with the accompanying drawings, wherein.

DETAILED DESCRIPTION OF PREFERRED EMBODIMENTS

Figure 1:
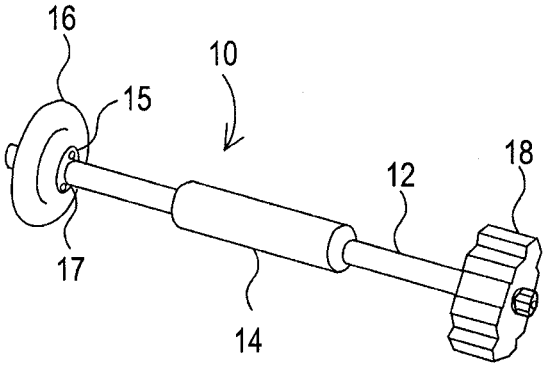
FIG. 1 is a perspective view showing a combination probe and therapy device made in accordance with one embodiment of the invention.
Figure 4:
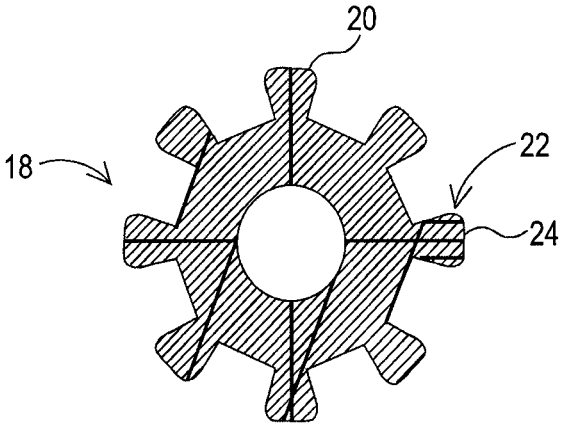
FIG. 4 is a cross-sectional view and FIG. 5 a side elevational view of a single wheel made in accordance with the present invention.
Figure 5:
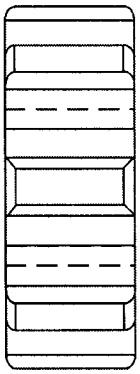

Referring first to FIGS. 1, 4 and 5, there is shown a combination probe and therapy device 10 comprising an elongate rod 12 having an enlarged handle 14. A round wheel 16 having a smooth peripheral edge formed of a hard plastic having a diameter of 2.0 inches is rotatably mounted adjacent one end of rod 12. Preferable wheel 16 is rotatably mounted to rod 12 on ball bearings and is held in position on rod 12 by snap rings or retaining rings 15 which are snapped onto peripheral grooves 17 formed in the rod 12.

The other end of the rod, i.e. opposite wheel 16, carries mounted thereon a segmented wheel 18. Referring also to FIGS. 4 and 5, wheel 18 is also formed of a hard plastic or rubber, and has eight projections 20 evenly spaced around the wheel. Projections 20 are about 0.750 inches at their widest point, and project 0.1325 inches from the core of roller 18. Projections 20 are 0.283 inches wide at their widest point, and have a rounded taper or bevel 22 adjacent their outer surface 24.

In use, the clinician grasps the therapy device 10 by handle 14 and rolls the round wheel 16 along the muscle to be evaluated or treated. By rolling wheel 16 along the muscles, the presence of trigger points and adhesions will be felt through the wheel and handle by to the user. Having then determined the location of trigger points and adhesions, the user may then roll the segmented roller back and forth across the trigger points and adhesions. Typically the trigger points and adhesions are released in 15-60 seconds.

Figure 2:
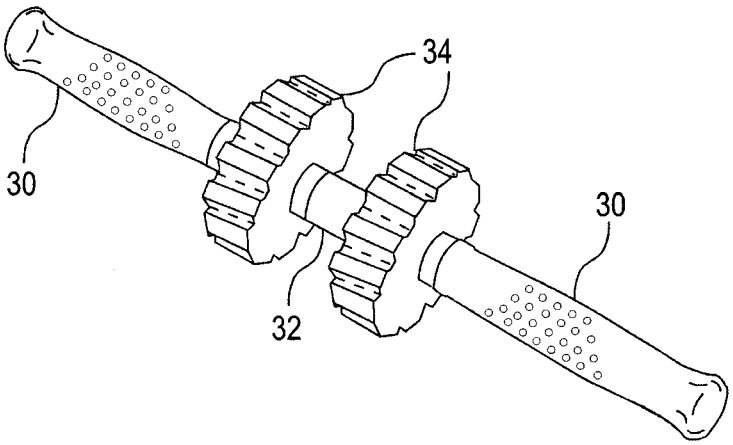
FIG. 2 is a view similar to FIG. 1 of a therapy device made in accordance with the present invention.

Referring to FIG. 2, there is shown an alternative embodiment of a therapy device made in accordance with the present invention. The FIG. 2 embodiment differs from FIG. 1 in that there are a pair of handles 30 mounted to the outside of rod 32. A pair of segmented wheels 34 similar to wheel 18 are rotatably mounted in the mid-section of rod 32. Wheels 34 are spaced from one another 1.25-1.75 inches, preferably about 1.50 inches.

Figure 3:
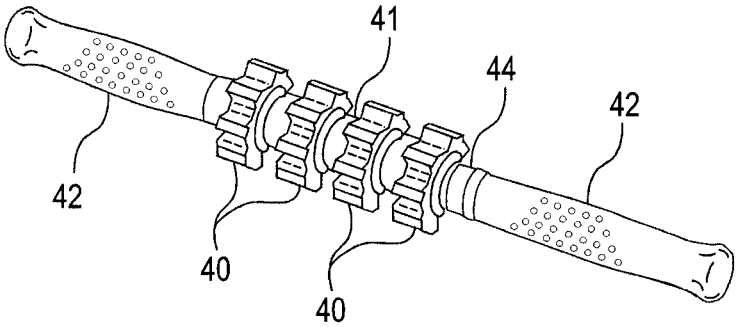
FIG. 3 is a view similar to FIG. 1 of an alternative embodiment of therapy device made in accordance with the present invention.

Yet another embodiment is shown in FIG. 3. The FIG. 3 embodiment is similar to FIG. 2, except that there are four segmented wheels 40 mounted interiorly of the handles 42 on rod 44. Wheels 40 are similar to roller 18, and are spaced from one another 0.50-0.75 inches, preferably about 0.50 inches on center by spacers 41.

The present invention provides many functions, advantages and benefits not achievable by prior art devices. For one, the therapy device of the present invention may be used both to detect and treat muscle trigger points and tight myofascial adhesions. This in turn increases range of motion and relieves pain. Vigorously rolling the therapy device along the muscles warms up the muscles by increasing circulation (hyperemia) thereby increasing oxygen-laden and nutrient rich blood flow to the muscles. The therapy device also actively stretches and passively exercises the muscles, while massaging the muscles and stretching the overly fascia. The therapy device can be used to relieve muscle spasm and tightness which inhibit normal muscle function and performance. The therapy device also increases flexibility, strength and endurance, improves muscle recovery, restoration and regeneration. The therapy device also quickly provides relief for back and muscle aches and pains, and can be used also to provide relief for tight, sore and tired feet and plantar fascitis as well as provide relief for repetitive motion injuries. Use of the therapy device in accordance with the present invention also increases circulation to hypovascular areas of the tendons and aids in healing and increases elasticity of adhesions and reduces pain. Most lesions, muscles spasms, etc. may be removed in as little as 15-60 seconds. A feature and advantage of the present invention is that the wheel designs permit penetration into the fascia and muscle in varying degrees depending on pressure applied.

While the therapy device of the present invention has been described as being used primarily by medical providers, the instrument also is designed for home use and in many cases may be self applied.

Various changes may be made from the foregoing without departing from the spirit and scope of the invention. For example, a floor mount may be provided for treatment of plantar fascitis and plantar fascial fatigue. And smaller versions of the wheels may be used over smaller tissues, e.g. tendons and post-surgical adhesions to aid in proper healing and reduction in scar tissue formation. The invention also may be used to promote lymphatic drainage. Still yet other changes are possible.

The invention claimed is:

1. A therapy tool comprising:

one or more roller wheels that penetrate or stretch muscle and overlying fascia and that treat muscular pain, myofascial pain, trigger points, and adhesions when rolled along or across muscle;

a shaft comprising an elongate rod having an enlarged handle;

wherein at least one of the roller wheels is rotatably mounted on the shaft and has a single row of a plurality of projections for trigger point therapy evenly spaced around the roller wheel's periphery;

each projection having a petal-shaped profile with a generally flat outer surface and a rounded edge, a rectangular cross section, and an aspect ratio between 1:1 and 1:2 relative to the core of the roller wheel; and each projection having a height of 0.250 to 0.400 inches, thereby allowing the user to feel the presence of trigger points and adhesions through the wheel and handle.

2. The therapy tool according to claim 1, wherein the at least one roller wheel has 8 to 12 projections evenly spaced around the roller wheel's periphery.

3. The therapy tool according to claim 1, wherein the one or more roller wheels have a diameter of ¾ to 6 inches.

4. The therapy tool according to claim 1, wherein the one or more roller wheels have a diameter of about 2 inches.

5. The therapy tool according to claim 1, wherein each projection has the height of 0.3125 inches.

6. The therapy tool according to claim 1, wherein each projection has the width of between 0.200 and 0.283 inches.

7. The therapy tool according to claim 6, wherein each projection has the width of 0.28 inches.

8. The therapy tool according to claim 1, comprising two roller wheels spaced from one another between about 1.25 and about 1.75 inches on center.

9. The therapy tool according to claim 8, wherein the two roller wheels are spaced from one another 1.50 inches on center.

10. The therapy tool according to claim 1, comprising four roller wheels spaced from one another between about 0.50 and about 0.75 inches on center.

11. The therapy tool according to claim 10, wherein the four roller wheels are spaced from one another 0.50 inches on center.

12. The therapy tool according to claim 1, wherein at least one roller wheel has a smooth peripheral edge.

13. A method of treating muscular pain, myofascial pain, trigger points, and adhesions in the body, comprising rolling the roller wheels of the therapy tool of claim 1 over an affected area of the body of a patient in need thereof for a therapeutically-effective period of time.

14. The method according to claim 13, wherein the therapy tool is rolled over the affected area of the body for between 15 and 60 seconds.

15. The therapy tool according to claim 1, wherein the roller wheels are formed of a hard plastic or rubber.

16. A therapy tool for treating myofascial pain, comprising:

a shaft having a predetermined length and having a first end and second end;

a first handle disposed on the shaft at the first end;

a first wheel rotatably mounted on the shaft between the first handle and the second end;

a space centered on the shaft between the first end and the second end;

a second wheel rotatably mounted on the shaft between the space and the second end;

a second handle disposed on the shaft at the second end adjacent to the second wheel;

the first and second wheels each being independently articulatable when rolled over an affected area of a patient's body and having a core, a thickness, a periphery, and a single row of a plurality of projections for trigger point therapy evenly spaced around the periphery;

each projection having a petal-shaped profile with a generally flat outer surface and a rounded edge, a rectangular cross section, a length equal to the thickness of the wheel, and an aspect ratio of a width of the projection to a height of the projection is between 1:1 and 1:2 relative to the height of the projection from the core of the roller wheel.

17. The therapy tool of claim 16, wherein each projection has the height between 0.250 and 0.400 inches, the width between 0.200 and 0.283 inches, and the length of 0.750 inches.

18. The therapy tool of claim 16, wherein the plurality is 8 to 12.

19. The therapy tool of claim 16, wherein the first and second wheel each comprise a pair of wheels spaced between 0.5 and 0.75 inches on center from one another.

20. The therapy tool of claim 16, wherein the plurality is 8 to 12; wherein each projection has the height between 0.250 and 0.400 inches, the width between 0.200 and 0.283 inches, and the length of 0.750 inches; and wherein the first and second wheel each comprise a pair of wheels spaced between 0.5 and 0.75 inches on center from one another.

* * * * *